US009700133B1

(12) United States Patent
Marler, III et al.

(10) Patent No.: US 9,700,133 B1
(45) Date of Patent: Jul. 11, 2017

(54) METHOD FOR FORMING A CONTINUOUS BELT BRUSH

(71) Applicant: Felton, Inc., Londonderry, NH (US)

(72) Inventors: Donald James Marler, III, Emmaus, PA (US); Marc Godin, Pittsfield, NH (US); Lawrence Nieder, Concord, NH (US); Matthew Gorham, Hampstead, NH (US)

(73) Assignee: Felton, Inc., Londonderry, NH (US)

( * ) Notice: Subject to any disclaimer, the term of this patent is extended or adjusted under 35 U.S.C. 154(b) by 338 days.

(21) Appl. No.: 14/534,549

(22) Filed: Nov. 6, 2014

(51) Int. Cl.
*A46D 3/08* (2006.01)
*A46D 3/00* (2006.01)

(52) U.S. Cl.
CPC *A46D 3/08* (2013.01); *A46D 3/00* (2013.01)

(58) Field of Classification Search
CPC ..... A46D 3/00; A46D 3/08
USPC ..... 300/1, 2, 19, 21
See application file for complete search history.

(56) References Cited

U.S. PATENT DOCUMENTS 1,259,031 A * 3/1918 Mather ..... 300/21
1,713,027 A * 5/1929 Cleaves ..... A46B 3/04 15/197
2012/0291215 A1 11/2012 Garner

* cited by examiner

*Primary Examiner* — Mark Spisich
(74) *Attorney, Agent, or Firm* — Peter A. Nieves; Sheehan Phinney Bass & Green PA

(57) ABSTRACT

A method for manufacturing a flexible belt brush from a flexible brush element is disclosed. The axis of a cylindrical winding drum is aligned with a cylindrical winding base axis. A bottom winding of the flexible brush element is formed around the winding drum with the flexible brush element base adjacent to a winding drum outer surface and the flexible brush element surface disposed against the winding base. A winding ring is center aligned with the winding base and placed over the bottom winding. A top winding of the flexible brush element is formed around the winding drum adjacent to the winding ring. A compression ring is placed above the top winding. The winding bases are welded to form the base of the flexible belt brush.

14 Claims, 16 Drawing Sheets

1400

METHOD FOR FORMING A CONTINUOUS BELT BRUSH

FIELD OF THE INVENTION

The present invention is generally related to brushes, and more particularly is related to flexible strip brushes and flexible belt brushes.

BACKGROUND OF THE INVENTION

A flexible brush element of FIG. 1 is described in the U.S. Patent Publication No. 2012/0291215 A1 entitled "Flexible Strip Brush, Flexible Belt Brush, and Methods for Manufacturing Same," which is incorporated by reference herein in its entirety. FIG. 1 shows a flexible strip brush element 150, having a base 152 with a top 158 and a bottom and a multiplicity of monofilaments 155. Each of the monofilaments has a proximal end and a distal end. The flexible strip brush element has a bristle attachment region wherein the monofilaments are arranged in substantially parallel fashion. The proximal ends of the monofilaments are attached to the top of the base by way of the bristle attachment region within the base 152, and the distal ends of the monofilaments 155 are free and collectively form a bristle end zone 158 at the top. Within the bristle attachment region there is intermingling of a material from the base 152 and a material from the monofilaments 155, for example, thermoplastic. The material from the base 152 fills interstices between the monofilaments 155.

As shown by FIG. 2, a flexible strip brush 100 may be formed from two or more flexible strip brush elements 150 that are mutually bonded in side-by-side fashion so that the free distal ends of the monofilaments 155 cooperate to form a common bristle end zone 108. As shown by FIG. 3, the mutual bonding in side-by-side fashion may be at least partially accomplished by a side bonding region 220. The mutual bonding in side-by-side fashion may be at least partially accomplished by a bottom bonding region 230, as shown by FIG. 4.

A flexible belt brush element is a flexible strip brush element 150, as described above, where the two ends of the base 152 are joined by means of a joint to form an endless loop. The joint may be a scarf joint. The joint may be reinforced by cloth, tape, plastic sheeting, or a high-strength fiber-like material. The joint may be formed by thermal bonding, adhesive, or solvent welding.

As shown by FIG. 5, a flexible belt brush 500 may formed from two or more belt brush elements that are mutually bonded in side-by-side fashion so that the free distal ends of the monofilaments 555 cooperate to form a common bristle end zone 558. The mutual side-by-side bonding may be partially accomplished by a side bonding region or a bottom bonding region. The bottoms of the bases may cooperate to form a base 552 serving as a common belt drive surface. The base 552 may be formed from a flexible brush element 150 wound in helical fashion, adjacent coils of the helically wound base 552 being bonded in side-by-side fashion to form a jointless spiral, as shown by FIG. 6. The ends of the brush element 150 may be formed at an acute angle θ, for example, 45° or less, for example, by cutting the ends at the acute angle θ.

Manufacturing the flexible belt brush 500 may be difficult, as the flexible brush elements 150 may be difficult to align and hold in position for bonding. Therefore, there is a need in the industry to address the above mentioned issues.

SUMMARY OF THE INVENTION

Embodiments of the present invention provide a method for forming a continuous belt brush. Briefly described, the present invention is directed to a method for manufacturing a flexible belt brush from a flexible brush element. The axis of a cylindrical winding drum is aligned with a cylindrical winding base axis. A bottom winding of the flexible brush element is formed around the winding drum with the flexible brush element base adjacent to a winding drum outer surface and the flexible brush element surface disposed against the winding base. A winding ring is center aligned with the winding base and placed over the bottom winding. A top winding of the flexible brush element is formed around the winding drum adjacent to the winding ring. A compression ring is placed above the top winding. The winding bases are welded to form the base of the flexible belt brush.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The components in the drawings are not necessarily to scale, emphasis instead being placed upon clearly illustrating the principles of the present invention. The drawings illustrate embodiments of the invention and, together with the description, serve to explain the principals of the invention.

DETAILED DESCRIPTION

Figure 1:
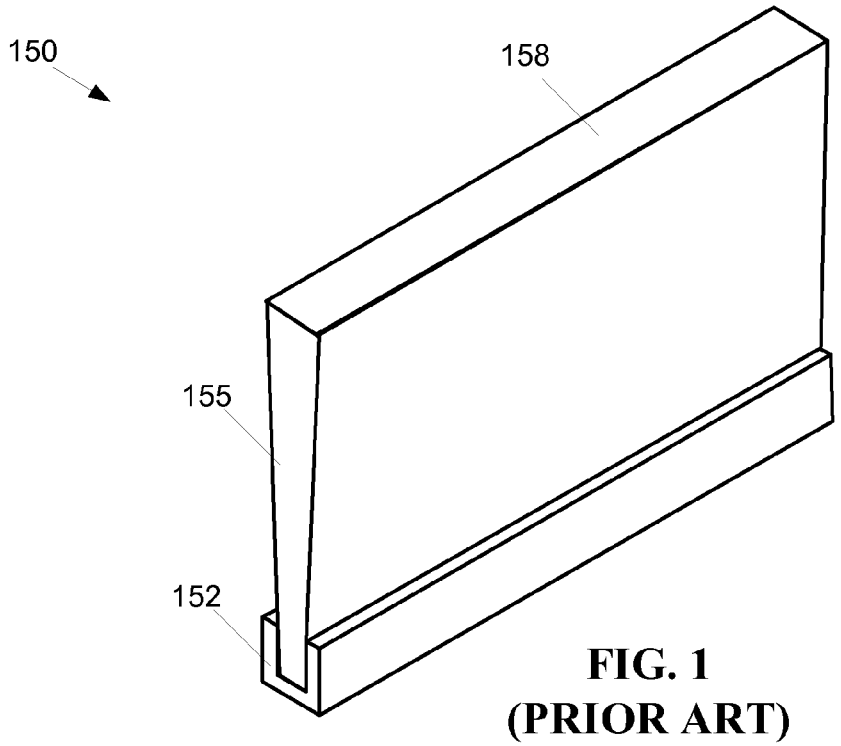
FIG. 1 (PRIOR ART)
FIG. 1 is a schematic diagram showing a prior art flexible strip brush element.
Figure 2:
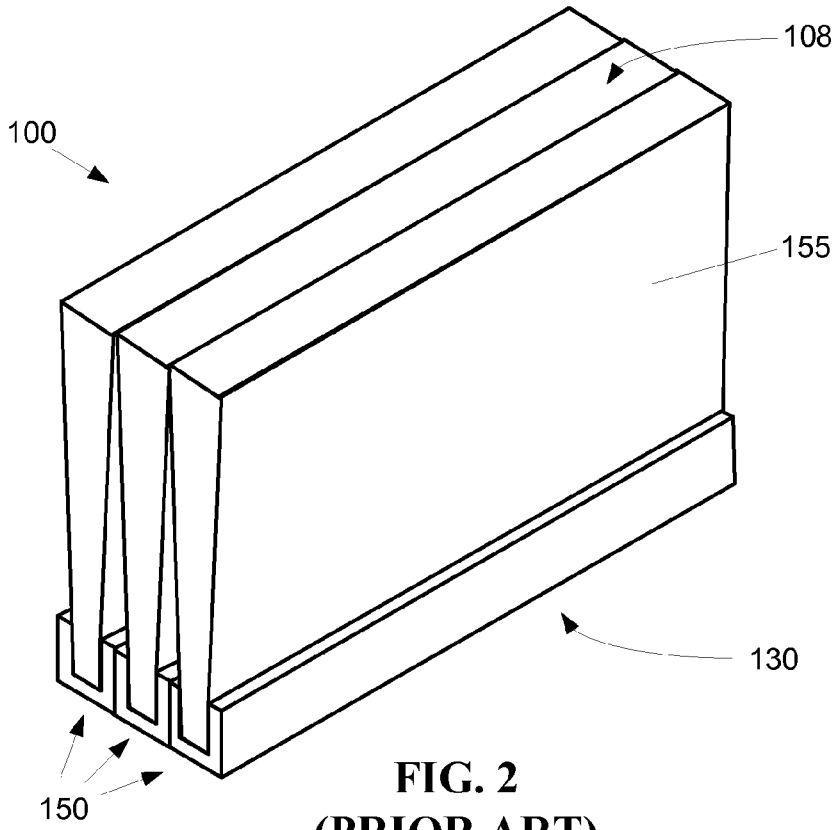
FIG. 2 (PRIOR ART)
FIG. 2 is a schematic diagram of a prior art flexible strip brush formed from two or more flexible strip brush elements of FIG. 1.
Figure 3:
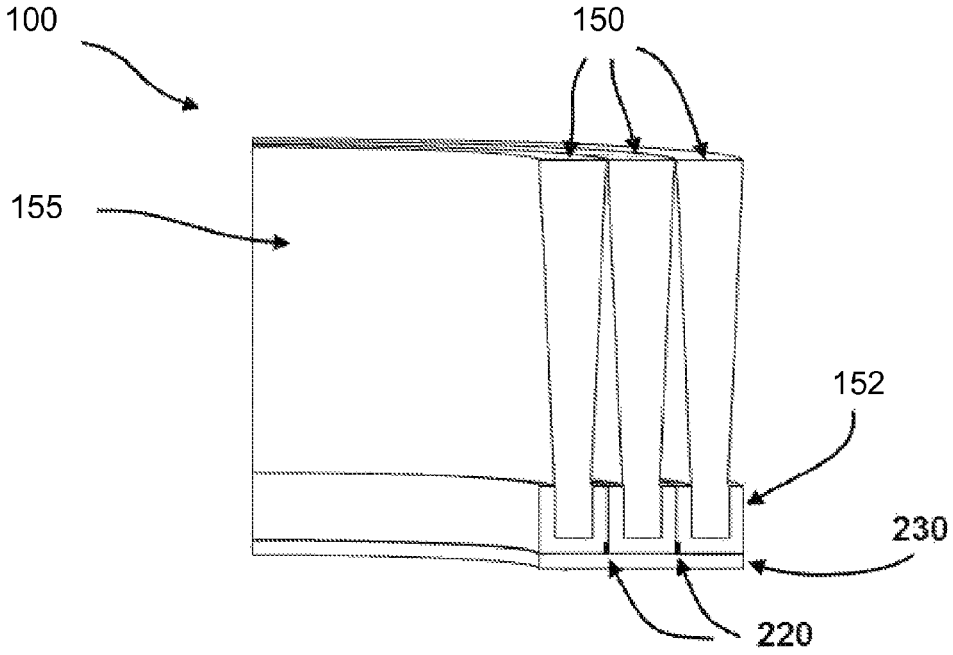
FIG. 3 (PRIOR ART)
FIG. 3 is a schematic diagram of the prior art flexible strip brush of FIG. 2, showing attachment areas for the flexible strip brush elements of FIG. 1.
Figure 4:
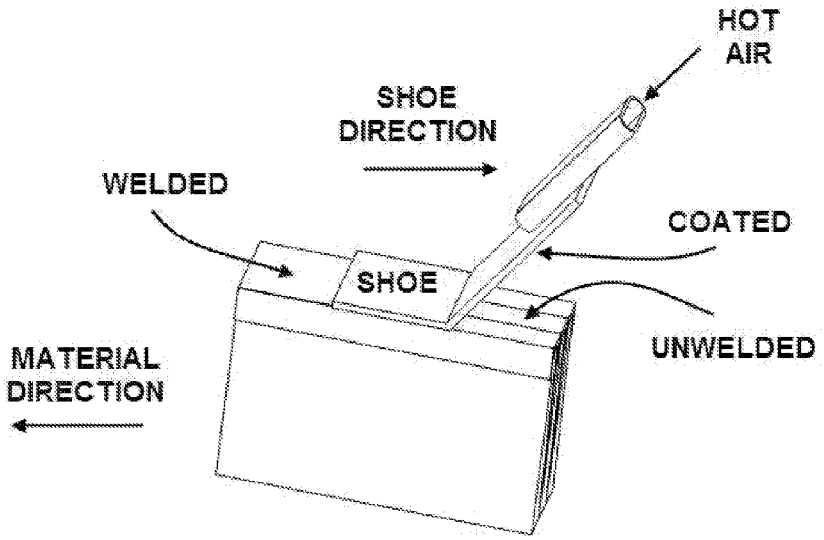
FIG. 4 (PRIOR ART)
FIG. 4 is a schematic diagram of a prior art bonding method for the flexible strip brush of FIG. 2.

The following definitions are useful for interpreting terms applied to features of the embodiments disclosed herein, and are meant only to define elements within the disclosure. No limitations on terms used within the claims are intended, or should be derived, thereby. Terms used within the appended claims should only be limited by their customary meaning within the applicable arts.

As used within this disclosure, "substantially" means "very nearly," or within manufacturing tolerances. For example, a substantially flat surface is a surface that a person having ordinary skill in the art would determine to be flat, allowing for minor manufacturing variances. Similarly, a substantially rigid material is a structurally rigid material that may be slightly deformed under moderate pressure, but generally will return to its original form when the pressure is removed.

Reference will now be made in detail to embodiments of the present invention, examples of which are illustrated in the accompanying drawings. Wherever possible, the same reference numbers are used in the drawings and the description to refer to the same or like parts.

Figure 5:
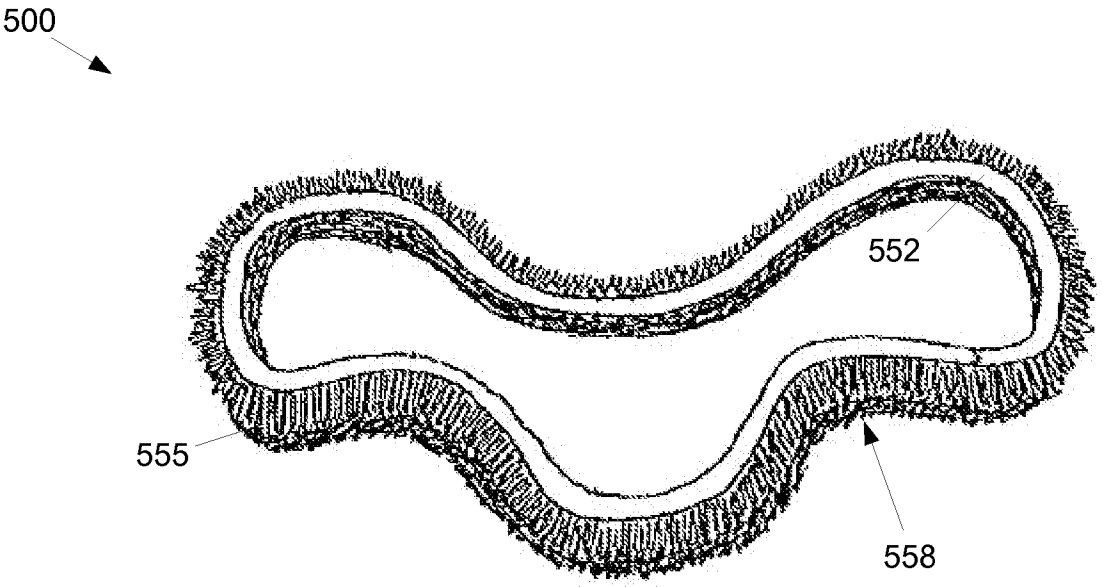
FIG. 5 (PRIOR ART)
FIG. 5 is a schematic diagram of one embodiment of a flexible belt brush.
Figure 6:
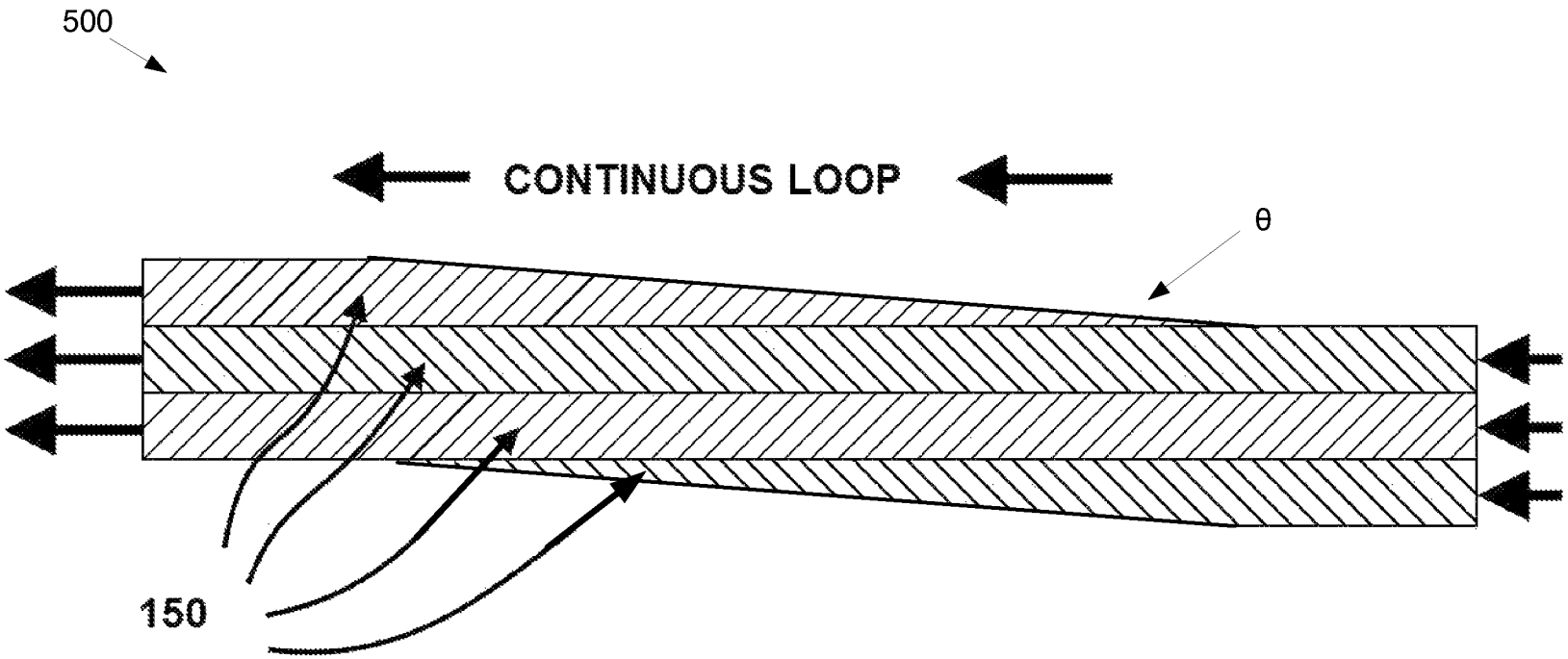
FIG. 6 (PRIOR ART)
FIG. 6. is a schematic diagram of a detail of the flexible belt brush of FIG. 5 formed as a continuous loop of a flexible strip brush element of FIG. 1.
Figure 7:
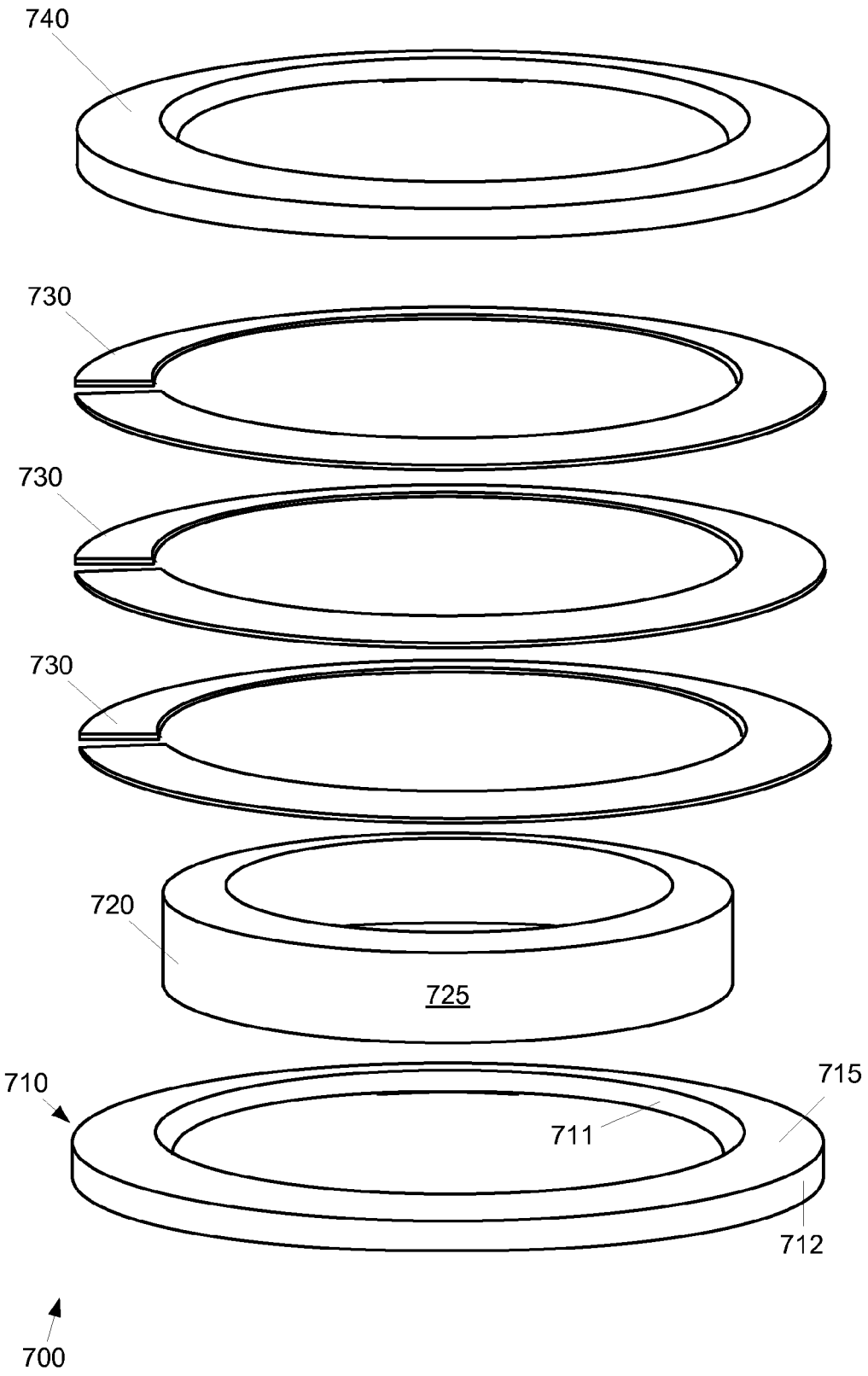
FIG. 7 is a schematic diagram of an exploded view of an exemplary winding jig for manufacturing the flexible belt brush of FIG. 5.
Figure 11A:
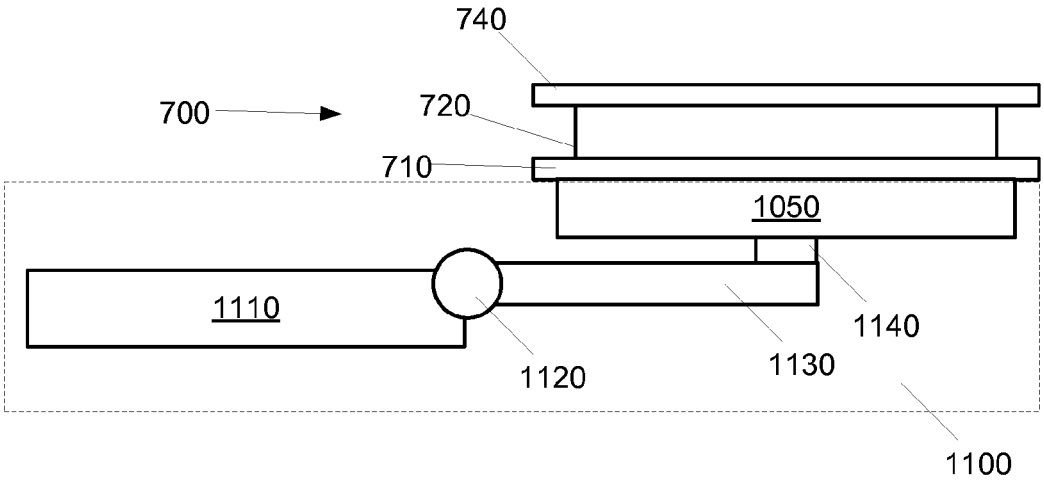
FIG. 11A is a schematic diagram of a mount for the jig of FIG. 7, shown in a horizontal orientation.

FIG. 7 is a schematic diagram of an exploded view of an exemplary rotatable winding jig 700 for manufacturing a flexible belt brush 500 (FIG. 5). The winding jig 700 holds one or more flexible strip brushes 150 (FIG. 1) in place for welding. The winding jig 700 includes a winding base 710. The winding base 710 may be generally ring shaped, and includes an inner edge 711, an outer edge 712, and a substantially flat winding surface 715. The winding base 710 may be mounted on a turntable 1050 (FIG. 11A). The winding base 710 is generally formed of a rigid material, for example aluminum, ceramic, steel, or other materials.

A winding drum 720 having a curved outer winding surface 725 may be removably mounted to the turntable 1050 (FIG. 11A) at least partially within the winding base 710, such that a center axis of the winding base 710 is aligned with a center axis of the winding drum 720. The winding drum 720 is generally formed of a rigid material, for example aluminum, ceramic, steel, or other materials. The winding drum 720 may be formed of the same material as the winding base 710, or may be formed of a different material.

Figure 8A:
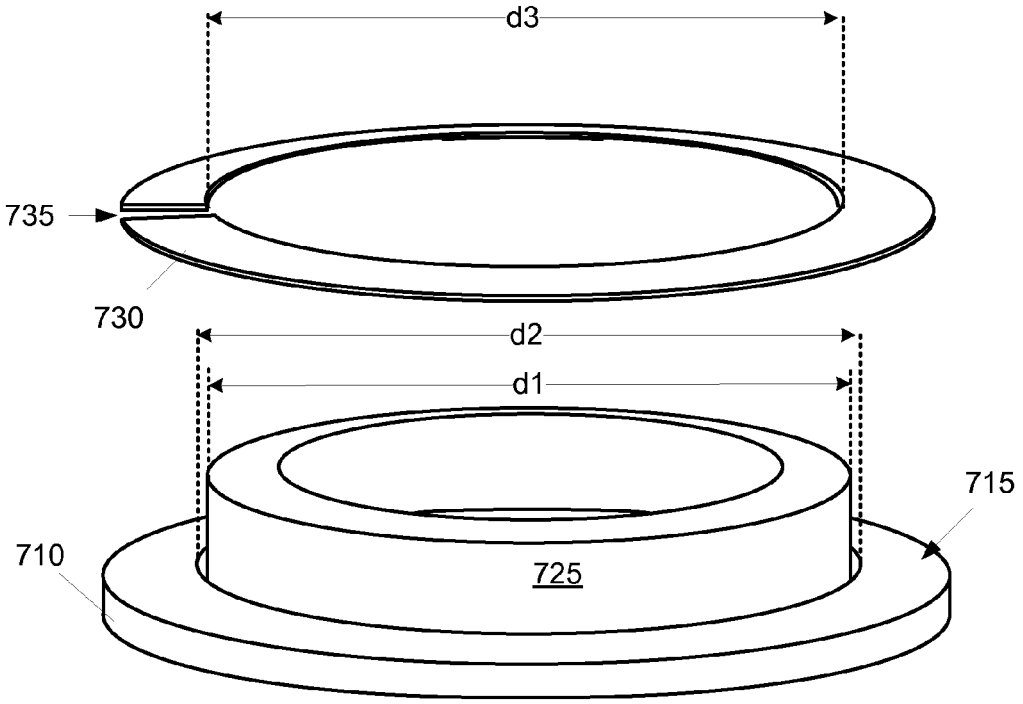
FIG. 8A is a schematic diagram of the jig of FIG. 7 showing the relative sizes of the drum as inserted into the base, and the cut flat ring.
Figure 8B:
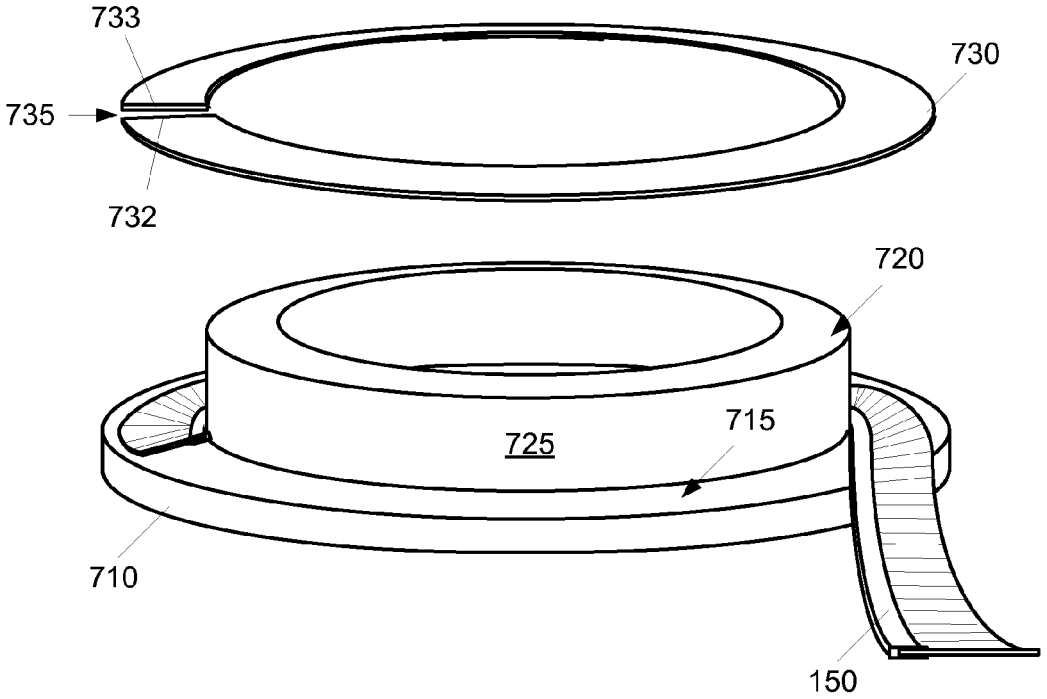
FIG. 8B is a schematic diagram of the jig of FIG. 7 showing a partial first winding of a flexible strip brush element relative to the slit in the cut flat ring.

As shown by FIGS. 8A-8B, an outer diameter d1 of the winding drum 720 corresponds to the diameter of the winding surface 725. This diameter d1 largely determines the length of the base 552 (FIG. 5) of the flexible belt brush 500 (FIG. 5). An inner diameter d2 of the winding base 710 is generally larger than the outer diameter d1 of the winding drum 720, so when the winding drum 720 is removed from the winding jig 700, the bases of the flexible strip brush windings 552 (FIG. 5) extend inward from the winding base 710, for example, providing welding access to the flexible strip brush winding bases 552.

A cut flat ring 730 having an inner diameter d3 may be positioned around the winding drum 720 and above the winding base 710. The cut flat ring 730 serves to separate successive flexible strip brush 150 windings. The cut flat ring inner diameter d3 may be larger than the winding drum outer diameter d1. The flat ring inner diameter d3 may be the same size as the winding base inner diameter d2, or may be larger or smaller than d2. The difference between d3 and d1 generally represents the weldable surface area between adjacent flexible strip brush 150 windings.

The cut flat ring 730 includes a slit 735 formed between the inner diameter d3 and a cut flat ring outer diameter. While the cut flat ring 730 is formed of a rigid material, for example, aluminum or steel, the cut flat ring 730 may be thin and flexible enough so that the edges of the ring at the slit 735 may be positioned such that they do not directly abut, so that a first end 733 of the cut flat ring 730 may be raised above a second end 732 of the cut flat ring 730, so that a winding of the flexible strip brush element 150 may be threaded through the slit 735.

Figure 8C:
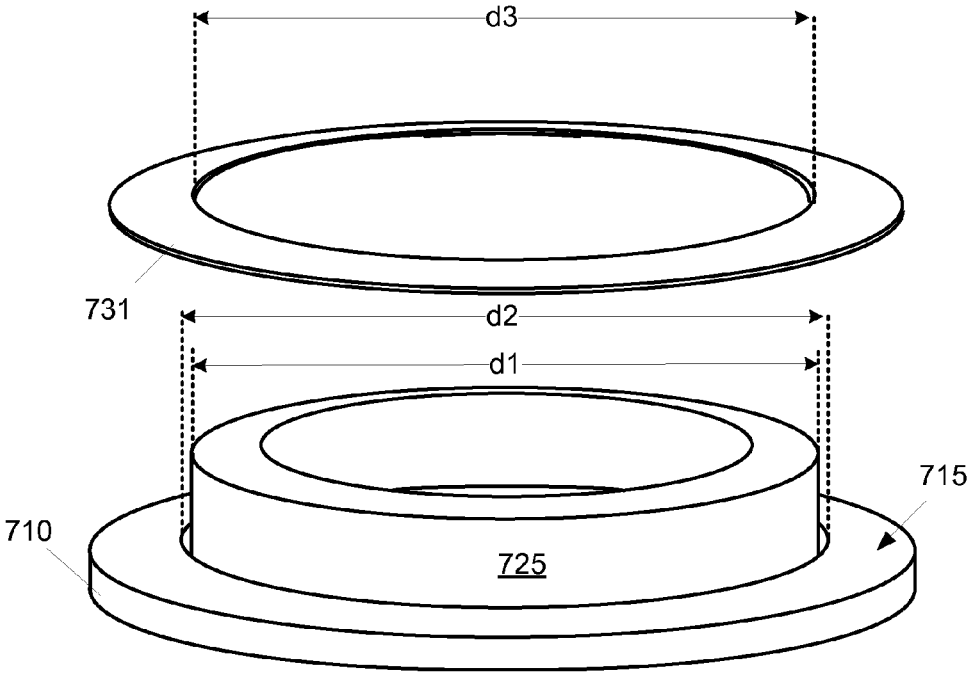
FIG. 8C is a schematic diagram of the jig of FIG. 7 showing the relative sizes of the drum as inserted into the base, and a flat ring instead of a cut flat ring.
Figure 8D:
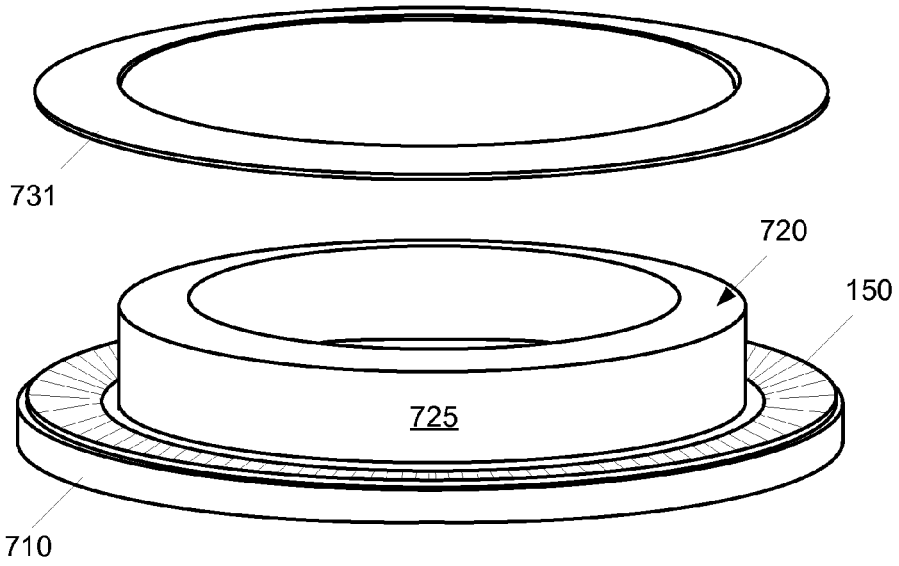
FIG. 8D is a schematic diagram of the jig of FIG. 7 showing a first winding of a flexible strip brush element.

In a second embodiment, as shown by FIGS. 8C-8D, a flat ring 731 without a slit 735 (FIG. 8A) may be used in place of a cut flat ring 730 (FIG. 8A). Flat rings 731 may be used to separate flexible strip brush element windings formed as individual belts. However, cut flat rings 730 (FIG. 8A) may also be used in this fashion, without threading the windings through the slit 735 (FIG. 8A).

Returning to FIG. 7, one or more cut flat rings 730 or flat rings 731 (FIG. 8C) may be used in the jig 700. While FIG. 7 shows three cut flat rings 730, more or fewer cut flat rings 730 may be used, depending upon the number of windings of flexible strip brush 150 to be used to form the belt 500 (FIG. 5). A flat ring 731 or a cut flat ring 730 may also optionally be used between the winding base 710 and the first (bottom) winding of flexible strip brush 150. Similarly, a flat ring 731 or a cut flat ring 730 may optionally be placed above the last (top) winding of flexible strip brush 150.

A compression ring 740 is configured to fit over the winding drum 720, above the cut flat rings 730. The compression ring may have an inner diameter substantially equal to the inner diameter d1 of the jig winding base 710. The compression ring 740 may be fastened to the jig winding base 710 in a manner so that the compression ring 740 applies pressure to the windings 150 of the belt brush 500 within jig 700, but does not obstruct the winding drum 720 from being removed from the jig 700. For example, the compression ring 740 may be clamped to the jig winding base 710 using external clamps (not shown) or threaded pins (not shown) passing through the compression ring 740 and the jig winding base 710, such that a desired amount of pressure may be applied to the belt brush 500.

FIG. 11A is a schematic diagram of an exemplary mount 1100 for the jig 700 (FIG. 7), shown in a horizontal orientation. The mount 1100 may include a turntable 1050, an axle (or spindle) 1140, a pivot arm 1130, a pivot hinge 1120, and a mount base 1110. The jig 700 may be attached to the turntable 1050, for example, by affixing the jig base 710 to the turntable 1050. The jig base 710 may be permanently affixed to the turntable 1050, or the jig base 710 may be removably affixed to the turntable 1050. The turntable 1050 rotates around the axle 1140. The jig 700 may be attached to the turntable 1050 such that the center axis of the jig 700 aligns with the rotating axis of the axle 1140. The turntable 1050 may rotate under power of a drive (not shown), such as a direct drive or a belt drive.

Figure 11B:
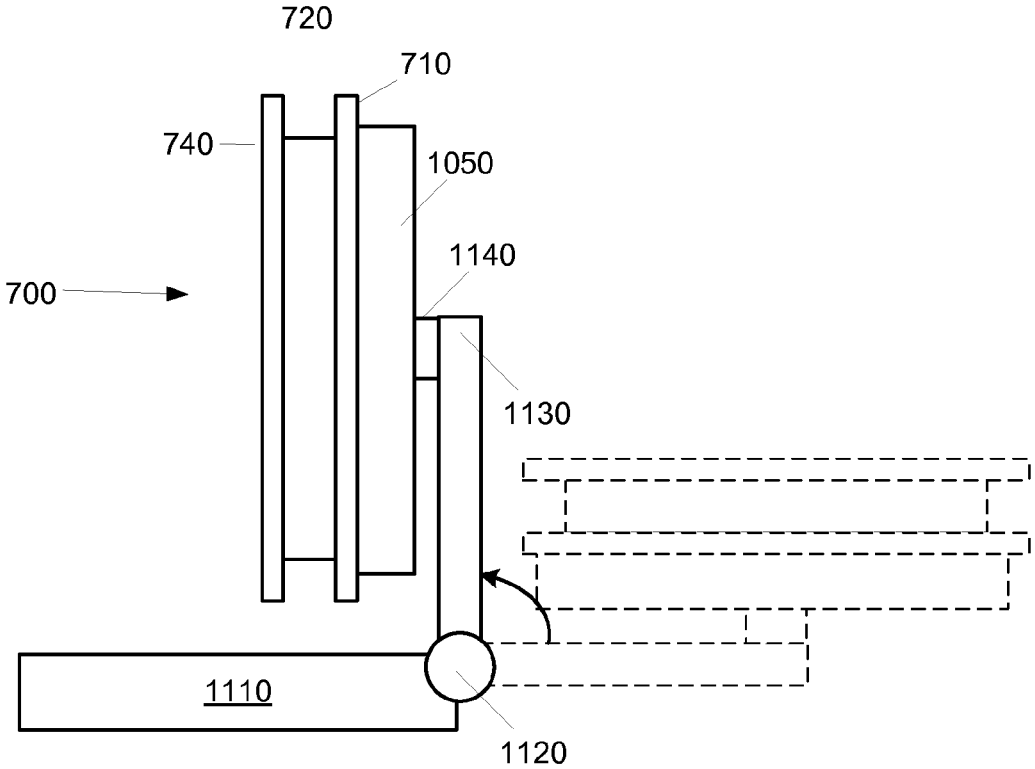
FIG. 11B is a schematic diagram of a mount for the jig of FIG. 7, shown in a vertical orientation.

The axle 1140 is attached to a distal end of the pivot arm 1130. A proximal end of the pivot arm 1130 is attached to the pivot hinge 1120. The pivot hinge 1120 pivots the pivot arm 1130 from a horizontal position, as shown in FIG. 11A, to a vertical position, as shown in FIG. 11B. The pivot hinge 1120 in turn pivots the jig 700 from a horizontal position to a vertical position. For example, the jig 700 may be oriented in the horizontal position for winding flexible strip brush elements 150 around the drum 720, and oriented in the vertical position for welding the bases 152 of the winding flexible strip brush elements 150 into a cohesive flexible belt brush base 552 (FIG. 5). The turntable 1050 may rotate the jig 700 while in both the horizontal position and the vertical position.

Figure 10A:
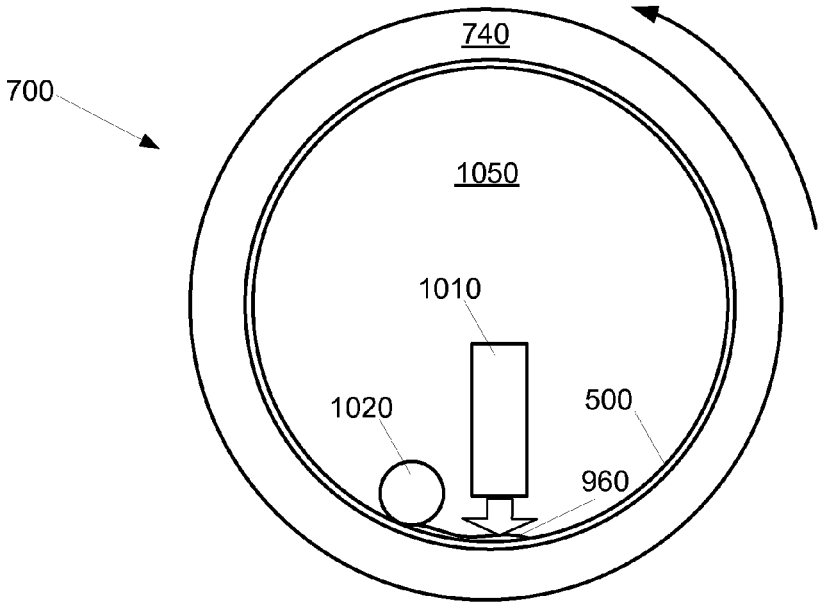
FIG. 10A is a schematic diagram of the jig of FIG. 7 illustrating a portion of a method for welding and rolling the windings.

FIGS. 10A-10D illustrate the jig 700 in the vertical position. FIG. 10A shows a side perspective of the jig 700 with the drum 720 (FIG. 10B) removed, and a heater 1010 positioned with the jig 700 to apply heat to the base of the flexible belt brush 500. The heat causes the bases 152 (FIG. 1) of the windings to at least partially melt, forming a pool of molten material 960 to form on the surface of the belt 500 at the bottom of the jig 700. For example, the bases may be formed of a melt-able material such as, but not limited to, thermoplastic. As the jig 700 rotates, for example in the direction indicated by the arrow in FIG. 10A, a roller 1020 compresses the molten material 960 upon the base of the brush 500. The heater 1010 may supply heat via convection with hot gas (air), or may directly apply heat to the base of the brush, for example, with a hot roller (not shown) or other heating means.

Figure 9A:
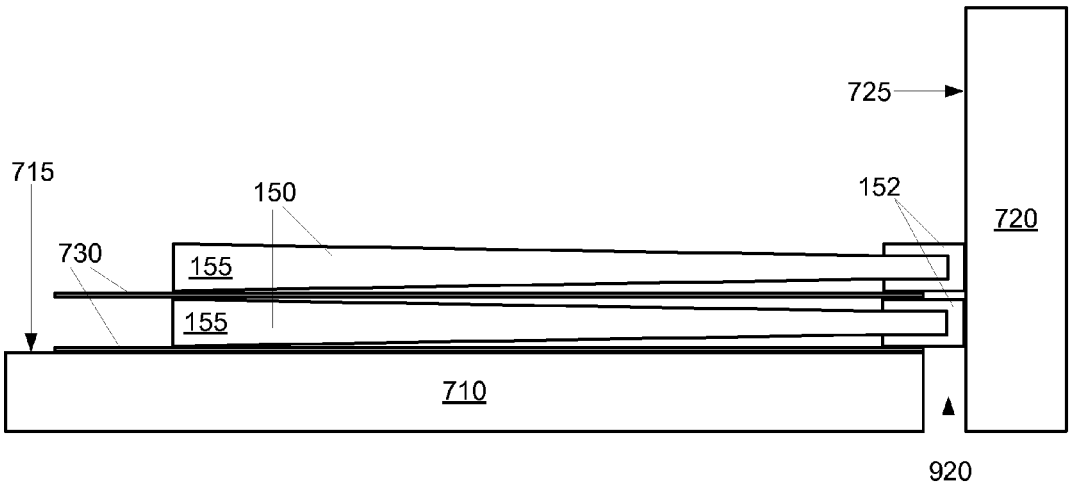
FIG. 9A is a schematic diagram of a cutaway view of a portion of the jig of FIG. 7 showing two flexible strip brush element windings.
Figure 9B:
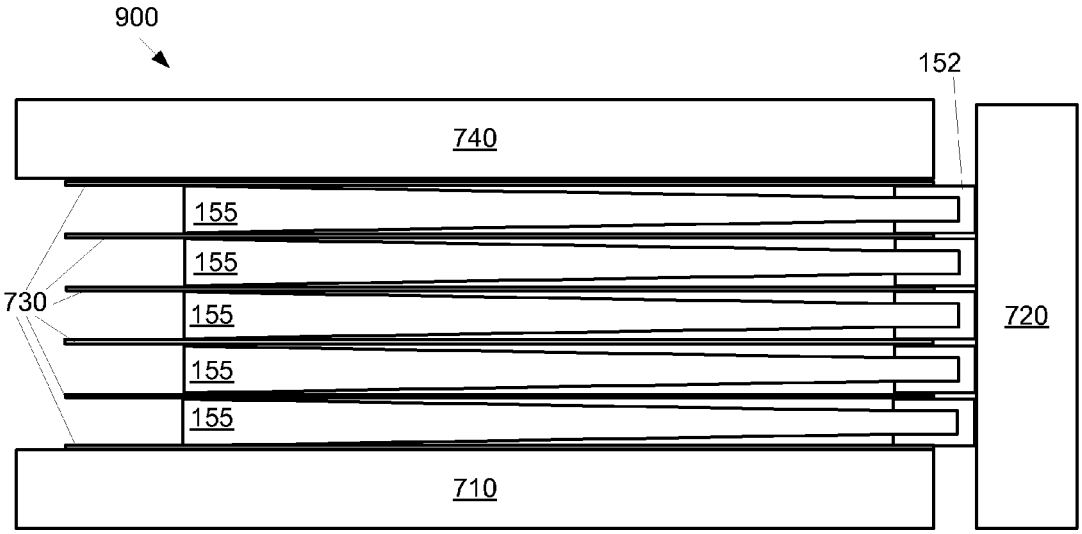
FIG. 9B is a schematic diagram of a cutaway view of a portion of the jig of FIG. 7 showing five flexible strip brush element windings beneath a compression ring.
Figure 10B:
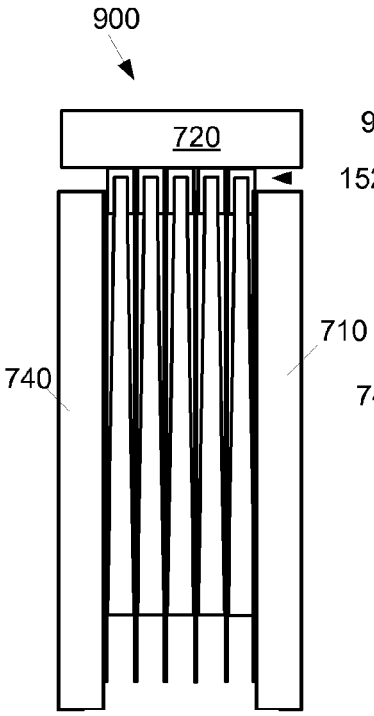
FIG. 10B is a schematic diagram of a cutaway detail of the jig of FIG. 7.
Figure 10C:
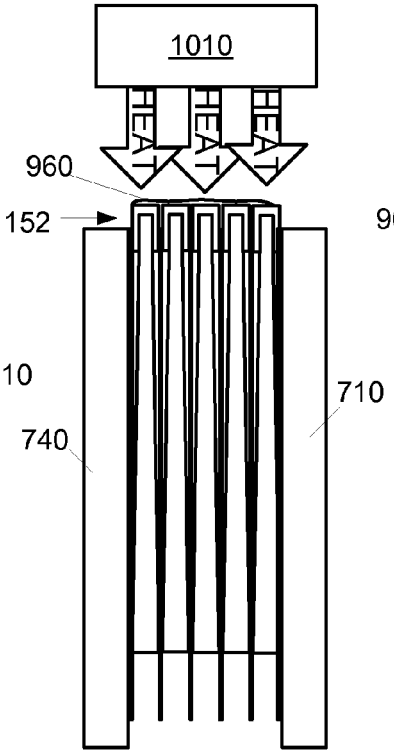
FIG. 10C is a schematic diagram of a cutaway detail of the jig of FIG. 7 illustrating a portion of a method for welding the windings.

FIG. 10B shows the features of FIG. 9B shown in a vertical orientation rather than a horizontal orientation. FIG. 10B shows a cutaway detail of the rig 700 with multiple windings compressed by the pressure ring 740. The winding drum 720 is removed from the jig 700 to expose the bases 152 of the windings 150. The winding drum 720 may be removed from the jig 700 while the jig is in the horizontal or vertical position. FIG. 10C shows the heater 1010 applying heat to the bases 152 of the windings 150, forming a melt pool 960.

Figure 10D:
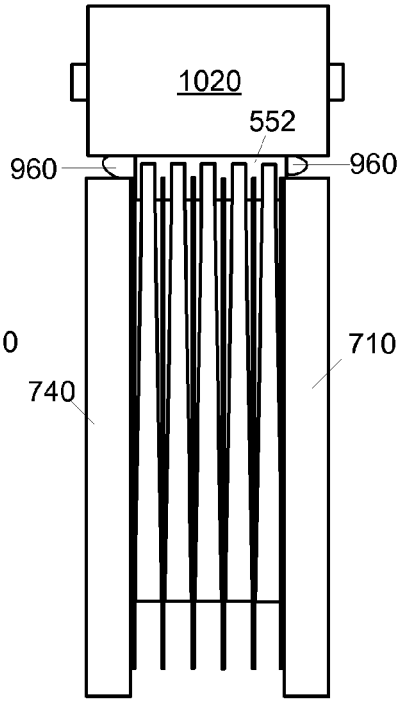
FIG. 10D is a schematic diagram of a cutaway detail of the jig of FIG. 7 illustrating a portion of a method for rolling the welded windings.

FIG. 10D shows a detail of the bases 152 having been welded together into the base 552 of the flexible belt brush 500 and compressed by the roller 1020 to form a substantially smooth surface of the belt brush base 552. As shown by FIG. 10D, some molten material 960 may be squeezed out and harden along the edges of the flexible belt brush 500, and may be removed by trimming the flexible belt brush 500 as described later. A backing material (not shown), for example, a structurally reinforcing material, may be applied to the belt brush base 552, before, during, or after compressing the base 552 with the roller 1020.

Figure 12:
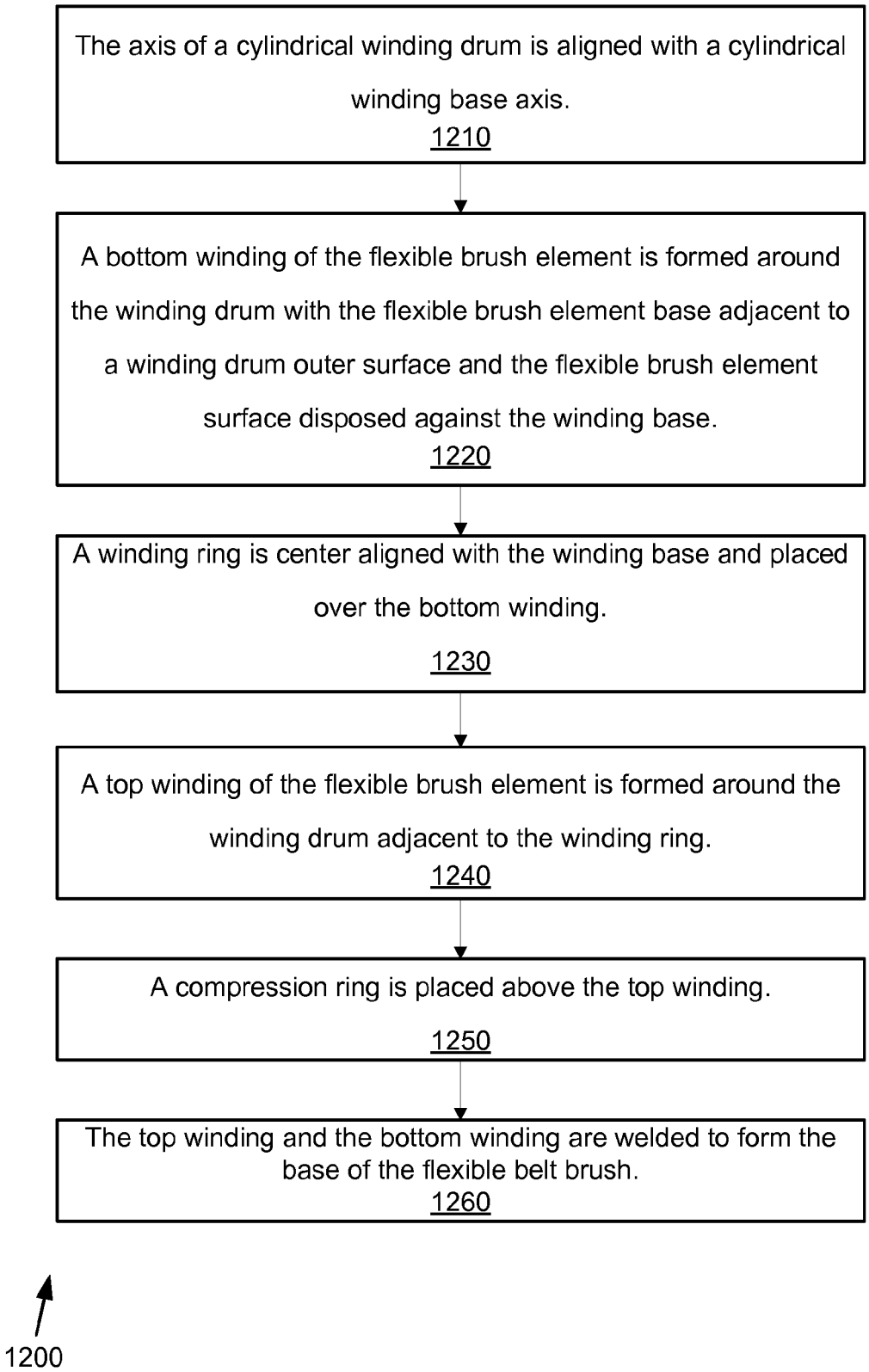
FIG. 12 is a flowchart of a first embodiment of an exemplary method for forming the flexible belt brush of FIG. 5.

FIG. 12 is a flowchart of a first embodiment of an exemplary method 1200 for forming a flexible belt brush 500 (FIG. 5). The method is described with reference to FIGS. 7A-11B. It should be noted that any process descriptions or blocks in flowcharts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention.

The axis of the cylindrical winding drum 720 is aligned with a cylindrical winding base 710 axis, as shown by block 1210. A gap 920 is left between the winding drum 720 outer surface 725 and the inner edge of the winding base 710, so that the windings protrude inwardly from the edge of the winding base 710, as shown by FIG. 9A.

A bottom winding of the flexible brush element 150 is formed around the winding drum 720 with the flexible brush element base 152 adjacent to a winding drum outer surface 725 and the flexible brush element surface 155 disposed against the winding base surface 715, as shown by block 1220. Alternatively, the flexible brush element surface 155 may be adjacent to a cut flat ring 730 or a flat ring 731 disposed between the winding base 710 and the bottom winding 150, as shown by FIG. 9A.

A flat ring (winding ring) 730 is center aligned with the winding base 710 and placed over the bottom winding, as shown by block 1230 and FIG. 9A. One or more central windings may be wound around the drum 720, with a cut flat ring 730 or a flat ring 731 separating each successive winding.

Successive windings may be formed of a continuous flexible brush strip element 150 helically wound around the winding drum 720. At the end of each winding, the flexible brush strip element 150 may be threaded through the slit 735 in the cut flat ring 730. Alternatively, successive windings may be formed of individual loops of flexible brush strip element 155 separated by a flat ring 731 or a cut flat ring 730.

A top winding of the flexible brush element 150 is formed around the winding drum adjacent to a cut flat ring 730 or a flat ring 731 overlaying the second topmost winding, as shown by block 1240. Optionally, a top flat ring 730 may be placed over the top winding. The top and bottom flat rings may be somewhat thicker or thinner than the cut flat rings 730 or flat rings 731 there between.

A compression ring 740 is placed above the top winding, as shown by block 1250 and FIG. 9B. The compression ring is configured to apply pressure on the windings between the compression ring 740 and the winding base 710, for example, to lessen or remove any gap between the bases 152 of successive windings prior to welding. The winding of the flexible brush element(s) 150 may be performed while the jig 700 is oriented in a horizontal position. It should be noted that while FIG. 9B depicts five windings, there is no objection to forming belts of fewer or more windings. For example, the winding drum 720 size may be extended to provide a larger winding drum outer surface 725 for accommodating a large number of windings. Similarly, the number of cut flat rings 730 or flat rings 731 used should be appropriate to the number of windings. In general, the number of cut flat rings 730 and/or flat rings 731 may be one less than the number of windings.

The top winding and the bottom winding are welded to form the base 552 of the flexible belt brush 500, as shown by block 1260 and FIG. 10C, along with any intermediate windings between the top winding and the bottom winding. Welding may be performed by applying heat to the winding bases 152 by a heater 1010. The welding of the flexible brush element(s) 150 may be performed while the jig 700 is oriented in a vertical position. The winding drum 720 may be removed from the jig 700 prior to welding. The welding may form a pool 960 of molten material from the melted bases 152 on and around the winding bases 152, which may be smoothed, for example, with a roller 1020. As noted above, optionally, a backing material (not shown), for example, a structurally reinforcing material, may be applied to the belt brush base 552, before, during, or after compressing the base 552 with the roller 1020.

Figure 13A:
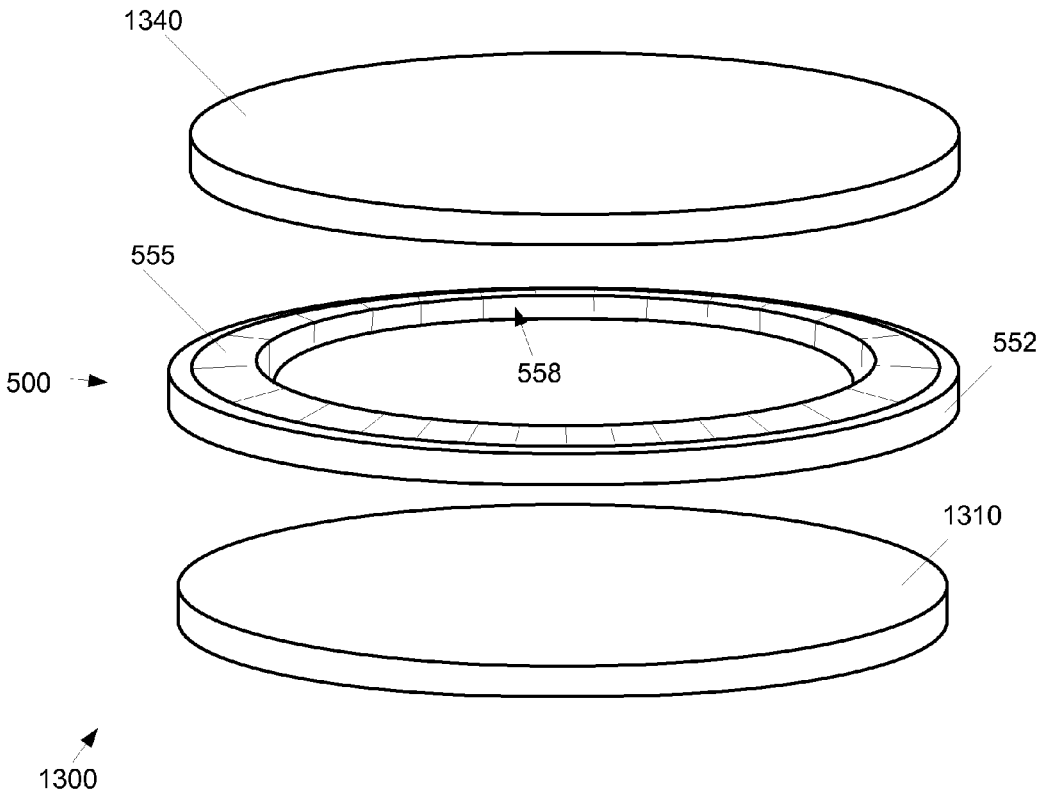
FIG. 13A is a schematic diagram of a device for edge trimming the flexible belt brush of FIG. 5, shown from an exploded perspective view.
Figure 13B:
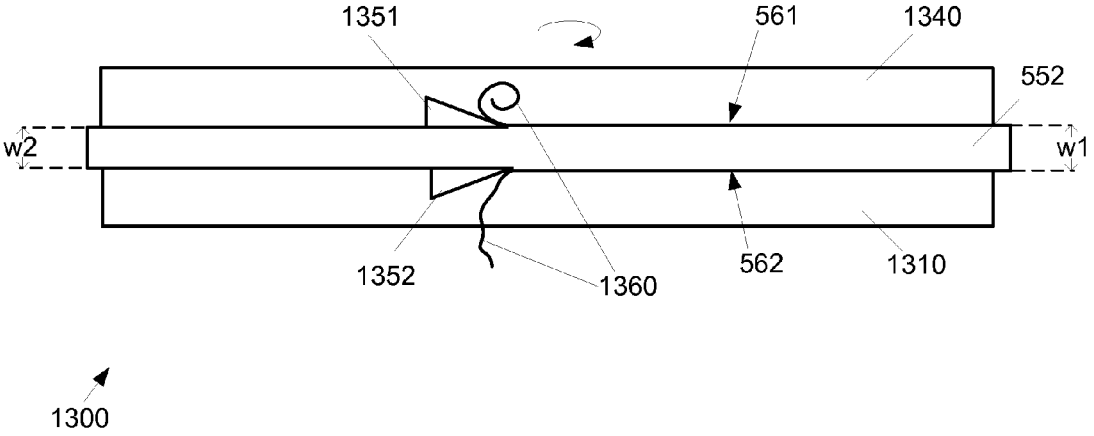
FIG. 13B is a schematic diagram of a device for edge trimming the flexible belt brush of FIG. 5, shown from a side view.
Figure 14:
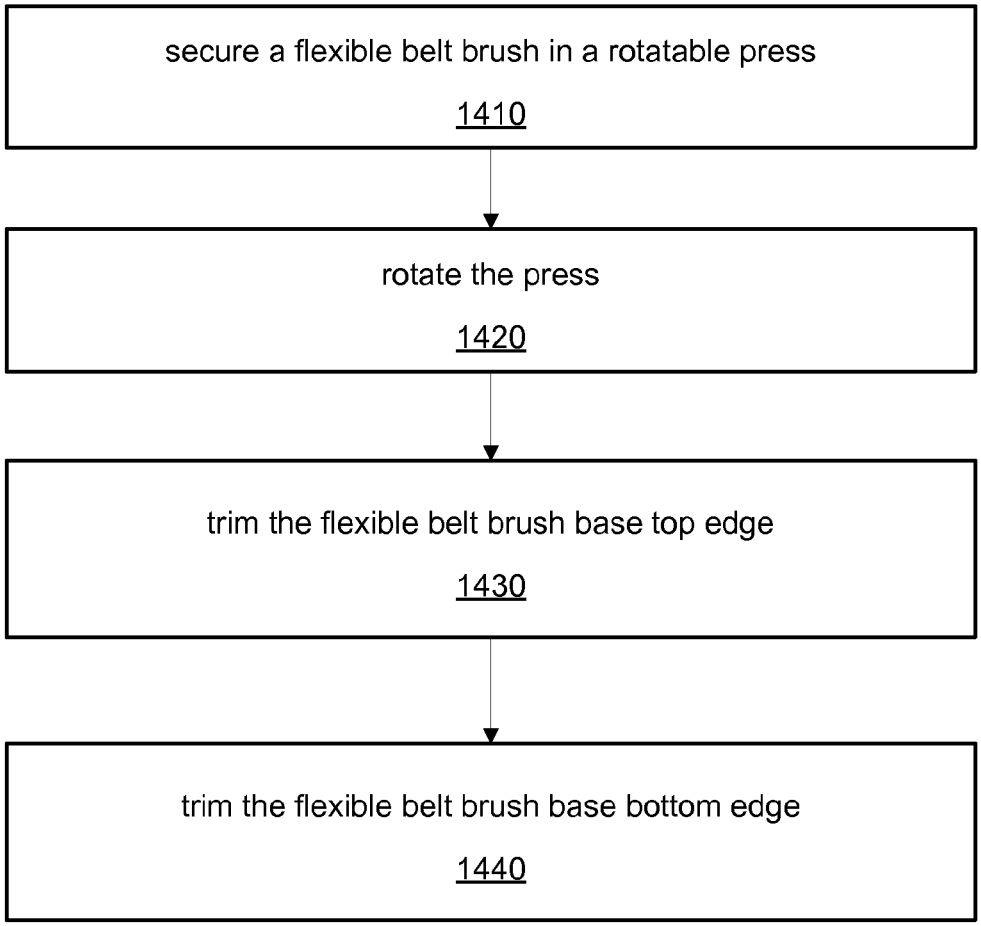
FIG. 14 is a flowchart of an exemplary method for edge trimming the base of the flexible belt brush.

FIG. 14 is a flowchart of an exemplary method for edge trimming the base 552 of the Flexible belt brush 500. FIGS. 13A and 13B illustrate a rotatable base trimming press 1300 that may be used in conjunction with the method. The flexible belt brush 500 is secured the rotatable press 1300, as shown in block 1410. The press 1300 includes a cylindrical top plate 1340 and a cylindrical bottom plate 1310. The top plate 1340 and bottom plate 1310 may have a common diameter smaller than a diameter of the flexible belt brush base 552. The flexible belt brush 500 is secured between the top plate 1340 and bottom plate 1310, with the bristles 555 pointed inward toward the center of the press 1300 and the flexible belt brush base 552 extending outward from the top plate 1340 and bottom plate 1310.

The press 1300 is rotated, as shown by block 1420. The press 1300 may be rotated by a drive (not shown), for example, a direct drive motor or a belt drive. A top edge 561 of the flexible belt brush 500 is trimmed with a top trimming device 1351, as shown by block 1430. The top trimming device 1351 may be a fixed blade, a rotating blade, such as a router bit, or other trimming means. A bottom edge 562 of the flexible belt brush 500 is trimmed with a bottom trimming device 1352, as shown by block 1440. The bottom edge 562 may be trimmed simultaneously with the top edge 561, or the edges may be trimmed one at a time, for example, during different trimming passes. The bottom trimming device 1352 may be a fixed blade, a rotating blade, such as a router bit, or other trimming means. As shown by FIG. 13B, the trimming devices 1351, 1352 removes trimmings 1360 of belt material from the portions of the belt 500 upper and lower edges 561, 562 that protrude outwardly from the press 1300. The width of the flexible belt brush base 552 is trimmed from a first width w1 to a narrower second width w2. Preferably, as a result of the trimming the edges 561, 562 are substantially uniform. Alternatively, the width of the belt base 552 may not be substantially decreased by the trimming, but rather residue 960 (FIG. 10D) from the welding process may be trimmed from the edges 561, 562 of the belt, along with any irregularities in the bottom and/or top edges 561, 562.

Figure 15:
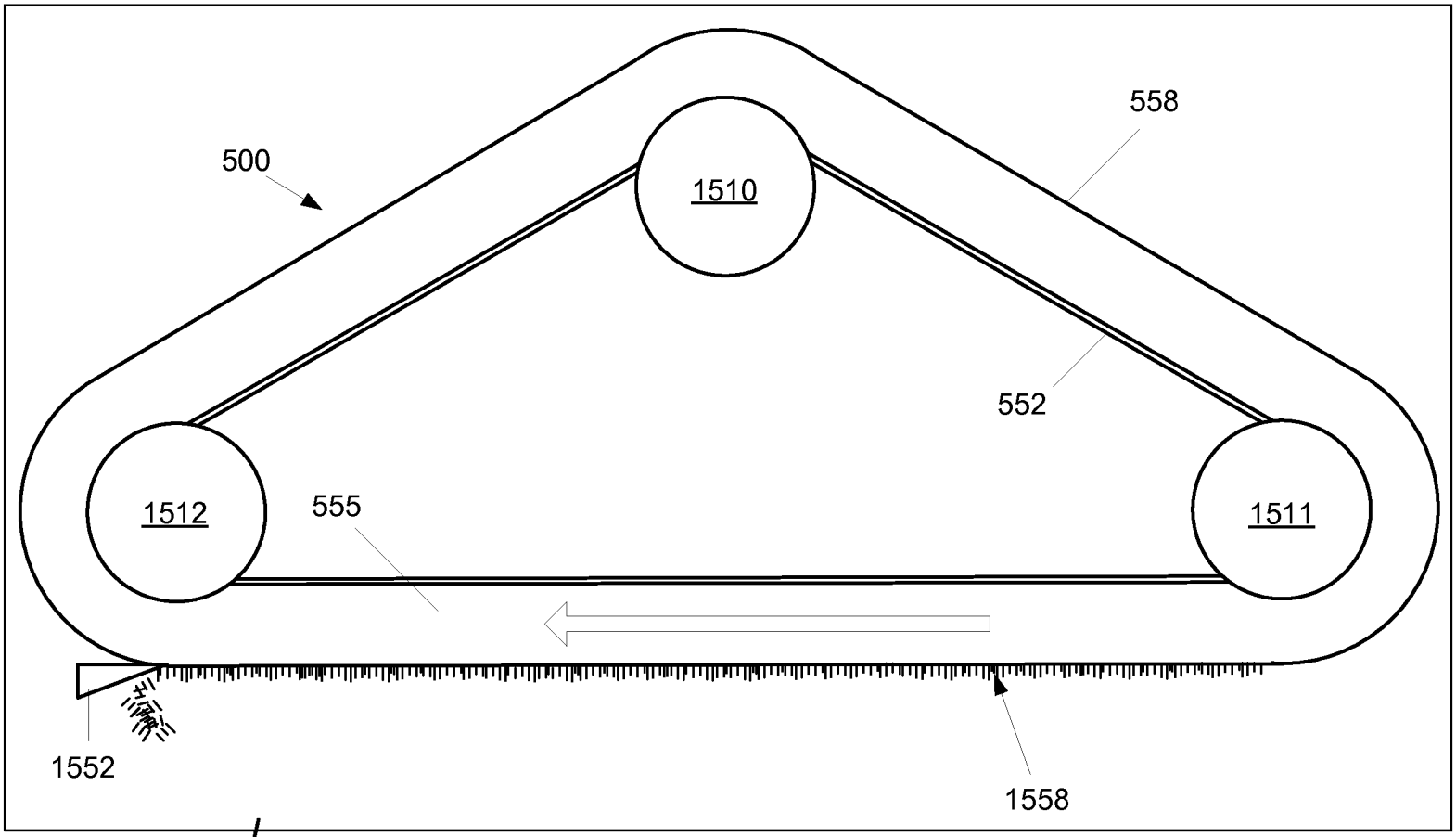
FIG. 15 is a schematic diagram of a device for trimming bristles of the flexible belt brush of FIG. 5, shown from a side view.
Figure 16:
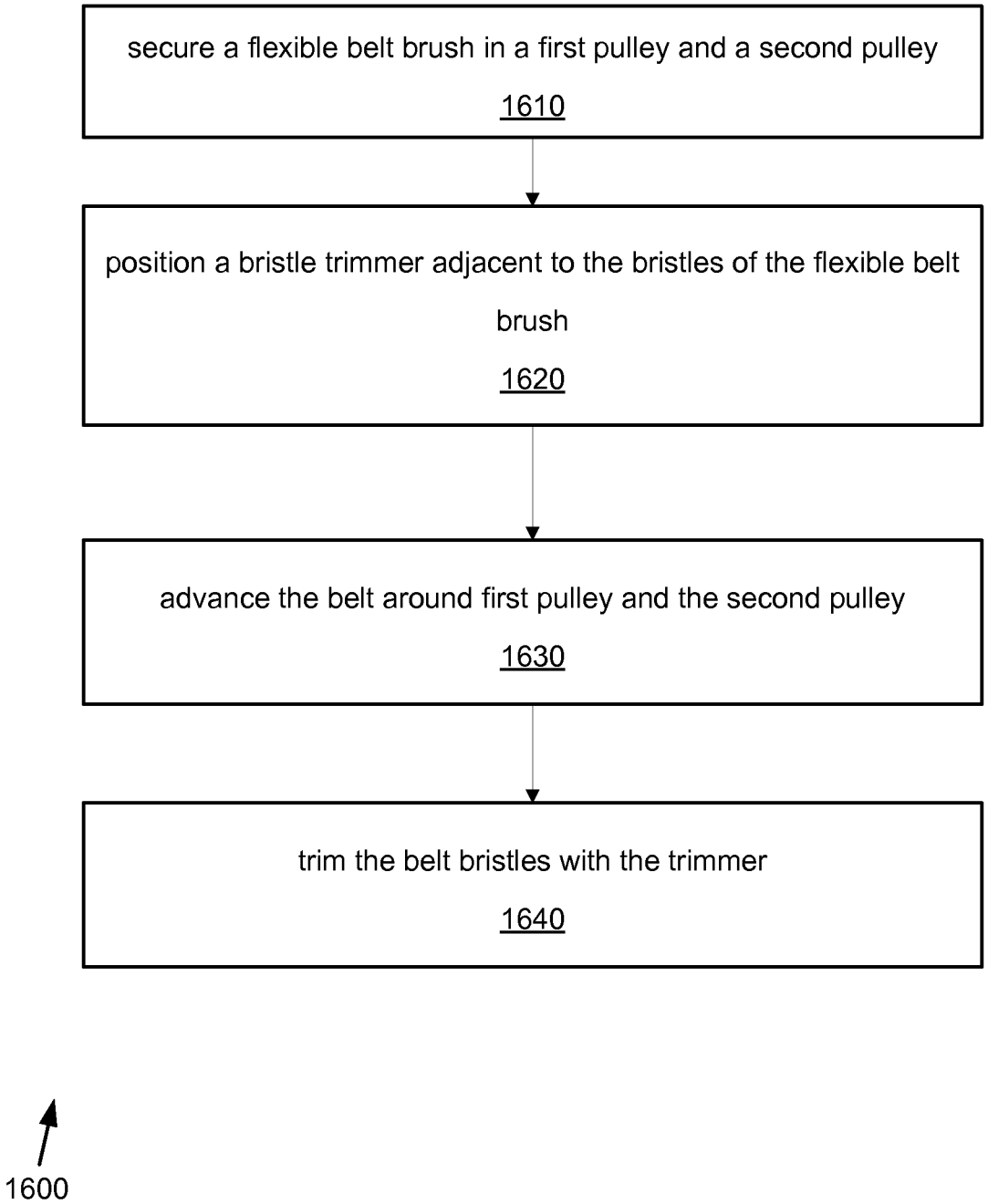
FIG. 16 is a flowchart of an exemplary method for edge trimming the base of the flexible belt brush.

FIG. 16 shows a flowchart of an exemplary method for trimming bristles of a flexible belt brush to a substantially uniform height. FIG. 15 illustrates an exemplary device 1500 for trimming bristles of a flexible belt brush 500 according to the method of FIG. 16. A flexible belt brush 500 is secured in a first pulley 1511 and a second pulley 1512, as shown by block 1610. The flexible belt brush base 552 is positioned adjacent to the rotatable surface of the first pulley 1511 and a surface of the second pulley 1512, and the bristle ends 558 of the flexible belt brush 500 point outward from the first pulley 1511 and the second pulley 1512. While FIG. 15 depicts a device 1500 with three pulleys 1510-1512, alternative embodiments may have two, four or more pulleys. In alternative embodiments, two or more belts may be secured simultaneously side-by-side in the pulleys 1510-1512.

A bristle trimmer 1552 is positioned adjacently to the bristles 1558 of the flexible belt brush 500, as shown by block 1620. The bristle trimmer 1552 may be, for example, a fixed blade, an oscillating blade, a rotating blade, or any other appropriate bristle trimming device. The position of the bristle trimmer 1552 in relation to the flexible belt brush 500 may be adjusted according to a desired bristle height for the flexible belt brush 500. The flexible belt brush 500 is advanced around first pulley 1511 and the second pulley 1512, as shown by block 1630. For example, the belt 500 may be advanced by rotating the first pulley 1511 and/or the second pulley 1512 by a direct or belt drive (not shown). As the flexible belt brush 500 advances, the bristle trimmer 1552 trims the bristles 1558 if the flexible belt brush 500, as shown by block 1640. The flexible belt brush 500 is advanced through at least one rotational cycle so the entire bristle surface 558 may be trimmed. One or more of the pulleys 1510-1512 may be repositioned, for example, to adjust the tension on the flexible belt brush 500, and/or to facilitate insertion and/or removal of the flexible belt brush 500 on the device 1500.

In summary, it will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for manufacturing a flexible belt brush from a flexible brush element comprising a base, a first surface, a second surface disposed substantially opposite the first surface, and a bristle zone disposed substantially opposite the base, comprising the steps of:

aligning a cylindrical winding drum axis with a cylindrical winding base axis;

forming a bottom winding of the flexible brush element around the winding drum with the flexible brush element base adjacent to a winding drum outer surface and the flexible brush element first surface disposed substantially parallel to a winding surface of the winding base;

aligning a winding ring axis with the cylindrical winding base axis;

placing the winding ring over the bottom winding;

forming a top winding of the flexible brush element around the winding drum with the flexible brush element base adjacent to the winding drum outer surface and the flexible brush element first surface disposed adjacent to the winding ring;

placing a compression ring above the top winding; and welding the top winding and the bottom winding to form the base.

2. The method of claim 1, wherein:

adjacent windings of the flexible brush element comprise a continuous flexible brush element, and the winding ring further comprises a slit between a winding ring inner diameter and a winding ring outer diameter; and further comprising the step of threading the flexible brush element through the slit in the winding ring.

3. The method of claim 1 wherein adjacent windings of the flexible brush element comprise separate flexible brush elements.

4. The method of claim 1, wherein the winding drum outer surface comprises a first diameter, and the winding base comprises second diameter corresponding to an inner edge of the winding base, and the second diameter is greater than the first diameter.

5. The method of claim 1, further comprising the step of forming at least one middle winding of the flexible brush element around the winding drum between the top winding and the bottom winding.

6. The method of claim 1, wherein the winding drum is aligned with the winding base via a rotatable mount.

7. The method of claim 6, wherein the rotatable mount is configured to orient the winding base in a horizontal orientation and rotate the winding base in the horizontal orientation, and further configured to re-orient the winding base in a vertical orientation and rotate the winding base in the vertical orientation.

8. The method of claim 1, further comprising the steps of:

cutting a first end of the flexible brush element; and cutting a second end of the flexible brush element.

9. The method of claim 8, wherein the bottom winding of the flexible brush element comprises the first end of the flexible brush element.

10. The method of claim 9, wherein the first end and the second end of the flexible brush element are cut at a substantially similar angle in relation to a first edge and a second edge of the flexible brush element.

11. The method of claim 10, wherein the angle is an acute angle.

12. A device for manufacturing a flexible belt brush from a flexible brush element comprising a base, a first surface, a second surface disposed substantially opposite the first surface, and a bristle zone disposed substantially opposite the base, comprising:

a jig comprising:

a cylindrical winding base comprising a winding base inner radius;

a cylindrical winding drum comprising a winding drum outer radius smaller than the winding base inner radius, configured to be removably disposed at least partially within the winding base;

a plurality of winding rings configured to be disposed around the winding drum; and a compression ring configured to align with the winding base around the winding drum and the plurality of winding rings, and to compress the flexible brush element and winding rings with respect to the winding base.

13. The device of claim 12, further comprising a mount configured to rotate the jig.

14. The device of claim 13, wherein the mount is further configured to orient and rotate the jig in a horizontal position and a vertical position.

* * * * *